United States Patent [19]

Bouthillier

[11] Patent Number: 4,549,495

[45] Date of Patent: Oct. 29, 1985

[54] STITCH SHORTENING DEVICE FOR A BLIND STITCH SEWING MACHINE

[75] Inventor: Robert Bouthillier, Dayville, Conn.

[73] Assignee: Louis Hand, Inc., Fall River, Mass.

[21] Appl. No.: 647,151

[22] Filed: Sep. 4, 1984

[51] Int. Cl.[4] ..... D05B 1/24; D05B 27/22

[52] U.S. Cl. ..... 112/315; 112/178

[58] Field of Search ..... 112/314, 315, 176, 177, 112/178

[56] References Cited

U.S. PATENT DOCUMENTS

| | | | |
|---|---|---|---|
| 2,894,470 | 7/1959 | Buono | 112/178 |
| 3,985,088 | 10/1976 | Sugahara | 112/178 |
| 4,416,207 | 11/1983 | Maier | 112/315 X |
| 4,462,325 | 7/1984 | Motta et al. | 112/315 |

FOREIGN PATENT DOCUMENTS

| | | | |
|---|---|---|---|
| 2718937 | 11/1978 | Fed. Rep. of Germany | 112/178 |

*Primary Examiner*—Werner H. Schroeder

*Assistant Examiner*—Andrew M. Falik

*Attorney, Agent, or Firm*—McAulay, Fields, Fisher, Goldstein & Nissen

[57] ABSTRACT

A stitch shortening device for a blind stitch sewing machine. A multiple cam is provided for reciprocating the feed drive lever. An adjustment wheel with peripheral teeth regulates the drive position of the multiple cam for lengthening or shortening the stitch by adjusting the feed drive. A pneumatic motor drives a toothed wheel meshing with the peripheral teeth of the adjusting wheel. When the pneumatic power is applied, the motor rotates the adjusting wheel in the direction of rotation of the sewing machine shaft but at a greater speed to maintain the adjusting wheel in large stitch drive position. When the operator activates a switch to cut off the pneumatic drive, the toothed wheel is idled and the adjusting wheel is moved into short stitch drive position. Applying the pneumatic power again moves the adjusting wheel into large stitch drive position again.

9 Claims, 12 Drawing Figures

STITCH SHORTENING DEVICE FOR A BLIND STITCH SEWING MACHINE

BACKGROUND OF THE INVENTION

Two commonly used blind stitch machines are the U.S. Blind Stitch Machine and the Lewis Machine. Both of the machines are well known to those skilled in the art. Blind stitch machines are extensively used for seaming and sew a single threaded chain stitch. On seams, it is necessary to perform a tacking operation at the end of the stitch. To shorten the stitch on a standard blind stitch machine, a manual operation is required, taking up some time for the shortening and lengthening again. In U.S. Pat. No. 4,114,547 an attempt is made to provide a stitch shortening device by dropping the platen and loosening the hold of the drive teeth on the material. Hopefully, this will allow tacking by slipping the drive. However, this method is uncertain, and hit or miss, varying with the thickness and type of material.

SUMMARY OF THE INVENTION

The present invention is an improvement over the art in that the stitch adjustment is made by the operation of the stitch adjusting device on the sewing machine itself. A multiple cam is provided in the case of the U.S. Machine and modified in the case of the Lewis Machine for reciprocating the feed drive arm. An adjustment wheel with peripheral teeth regulates the position of the multiple cam. A pneumatic motor drives a toothed wheel meshing with the adjustment wheel. When the pressure is on, the pneumatic motor drives the toothed wheel and the adjustment wheel to maintain the adjustment wheel and cam in long stitch position. When the operator activates a switch, the pneumatic power is cut off and the pneumatic motor idles. This allows the adjustment wheel to rotate to the short stitch adjusting position for tacking. Applying the pneumatic power throws the cam into long stitch position again. The action is rapid and automatic in response to the operator's actions. Since the sewing machine feed remains untouched, the action is positive and sure.

DESCRIPTION OF THE INVENTION

Figure 1:
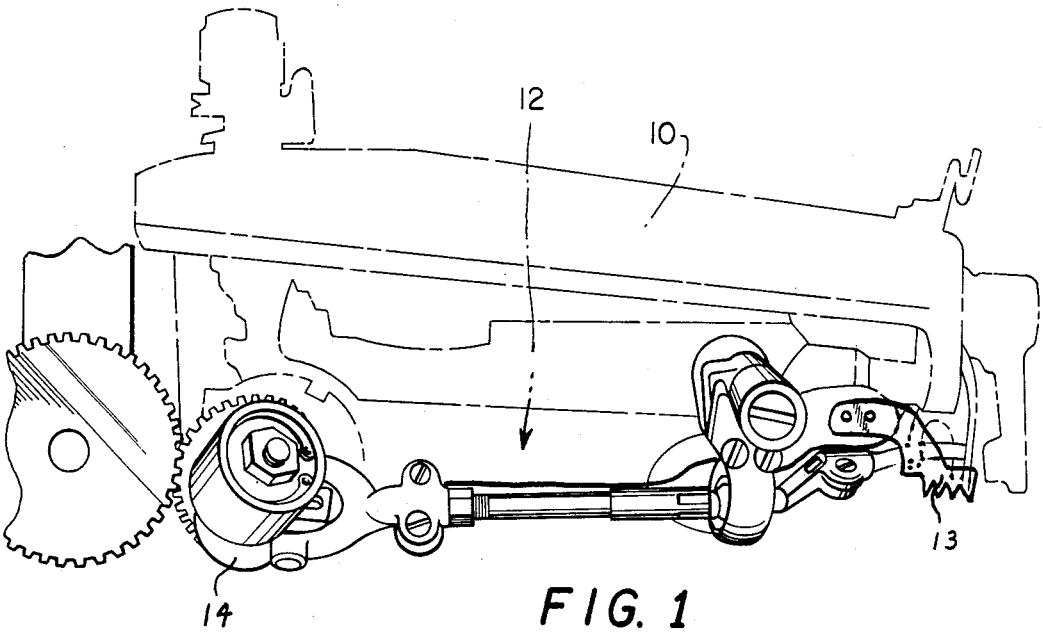
FIG. 1 is a side elevation of one type of blind stitch sewing machine used with one embodiment of the present invention.
Figure 2:
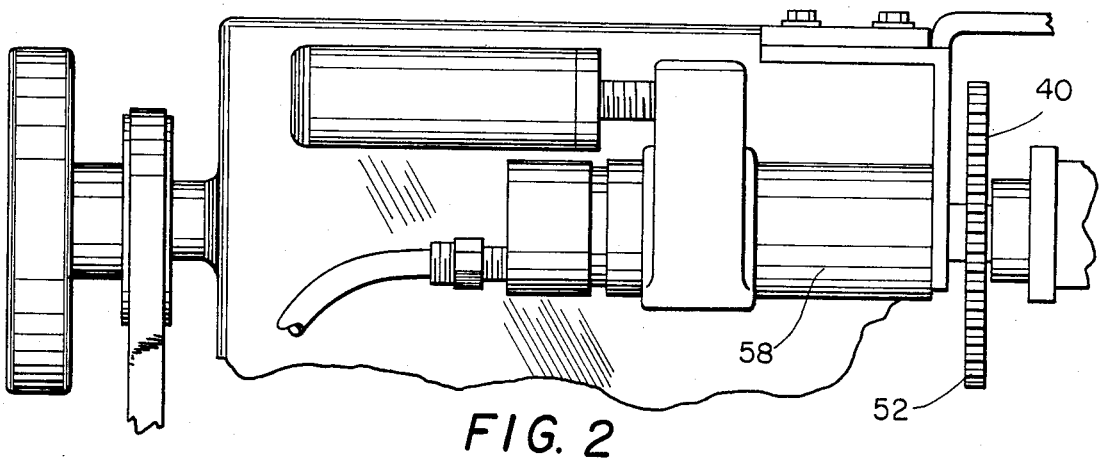
FIG. 2 is an enlarged rear elevation of the FIG. 2 machine showing the pneumatic drive device.
Figure 3:
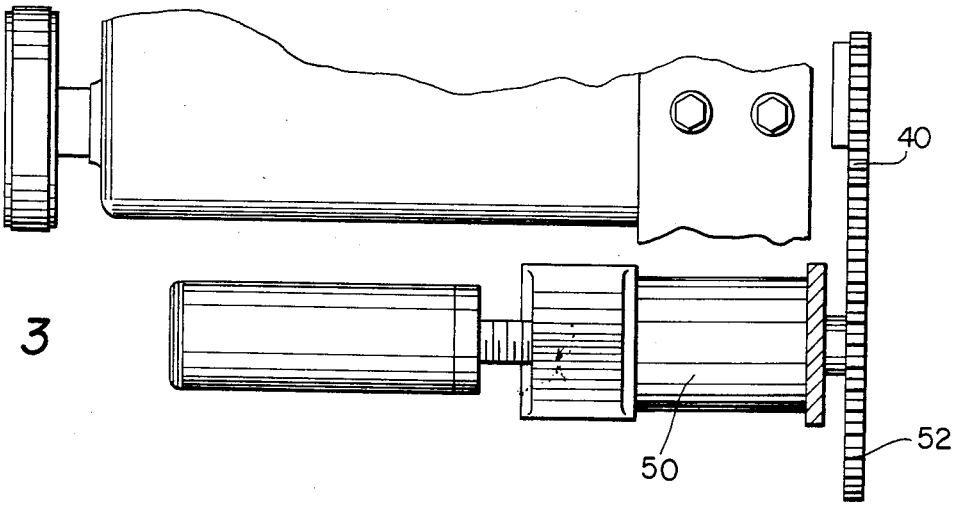
FIG. 3 is a top plan view of the pneumatic drive shown in FIG. 2.

The present invention is designed to provide for the shortening of the stitch as required by the operator. The basic principle entails the removal of the lock on the stitch adjustment to allow it to float freely. A pneumatic drive device is provided to retain the adjustment in normal operating position. When the operator cuts off the pneumatic drive, the adjustment swings to short stitch position to allow tacking. The device is simple and direct and does not alter the feed.

While the device is described and illustrated as mounted on blind stitch sewing machines, the mechanical principle can readily be applied to other types of sewing machines.

FIGS. 1–9 show one embodiment of the present invention as used on a machine such as the U.S. Blind Stitch Machine.

The blind stitch machine 10 is provided parallel to one side with a longitudinal reciprocating feed lever 12, which is part of the feed drive assembly. At the front end the feed lever 12 is attached to the sewing machine feed dog 13 for feeding the material under the needle. At the rear end, the feed lever 12 is provided with an integral loop 14 which surrounds a rotating cam for reciprocating the lever 12. The present invention pertains to the adjustment of the cam drive.

Referring to FIGS. 4–7, a drive shaft 16 extends laterally from the sewing machine 10 and is operated by the machine at a constant speed. At the other end of the shaft 16, a loop drive attachment 18 is provided with an integral eccentric drive member 20 which is fastened to rotate with the shaft 16 by a screw 22. The member 20 is surrounded by and drives the needle bar drive linkage 15. Integral with the member 20 is an annular disc or plate 24 from which the eccentric cam 26 extends. The shaft 16 extends through the opening 28 in the cam 26.

The above assembly is designed to rotate with the shaft 16 in a clockwise direction. An eccentric cam 30 having an enlarged opening 32 is provided. The loop 14 on the feed lever 12 is mounted on the cam 30. Outwardly, the cam 30 is provided with an integral enlarged annular portion 34 having an enlarged opening 36 aligned with the opening 32. The face of the annular portion 34 is provided with a radial groove 38.

An adjustment wheel 40 is provided with a recessed portion at one side 42 into which the plate 24 fits. The wheel 40 has a large central opening with a solid chord portion 44 carrying a pin 46 which engages the groove 38 on the cam member 34. The outer periphery of the adjustment wheel 40 is provided with teeth 48.

Figure 4:
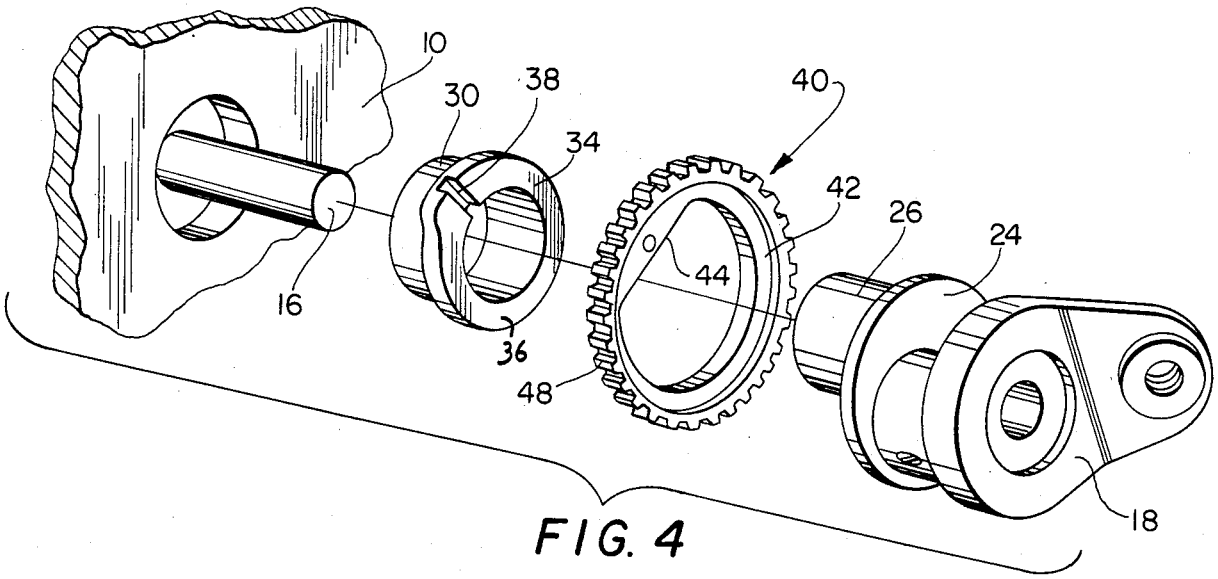
FIG. 4 is an enlarged exploded perspective view of the one embodiment of the present invention as used on the FIG. 1 machine.
Figure 5:
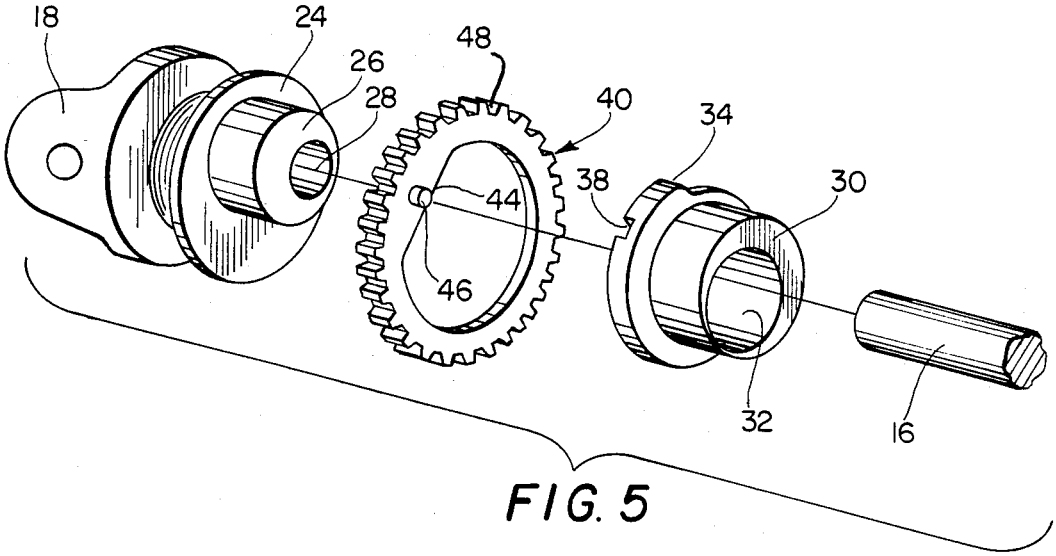
FIG. 5 is a view similar to FIG. 4 taken from the opposite direction.
Figure 6:
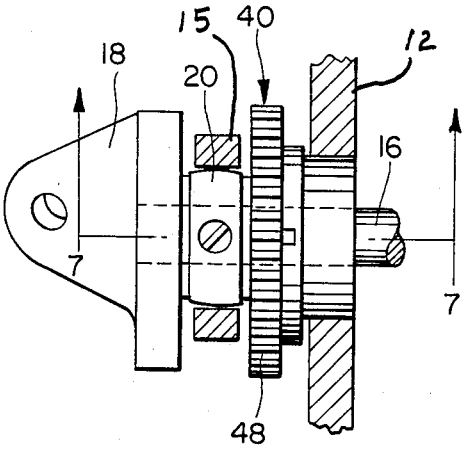
FIG. 6 is a side elevation partially in section, of one embodiment of the assembled stitch regulating mechanism of the present invention as used on the FIG. 1 machine.
Figure 7:
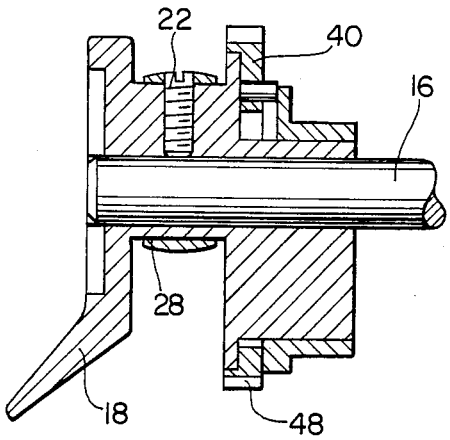
FIG. 7 is a section taken along line 7—7 of FIG. 6.

The adjustment wheel rotates the cam 30 through the groove 38. A pneumatic motor 50, mounted on the rear of the sewing machine 10, drives a toothed wheel 52 which meshes with the teeth 48 on the adjustment wheel 40. When the parts shown in FIGS. 4 and 5 are assembled as shown in FIGS. 6 and 7, the cam 30 rides over the cam 26 with the shaft 16 extending through both. The loop 14 is driven by the cam 30 whose atitude on the cam 26 is controlled by the wheel 40.

Figure 8:
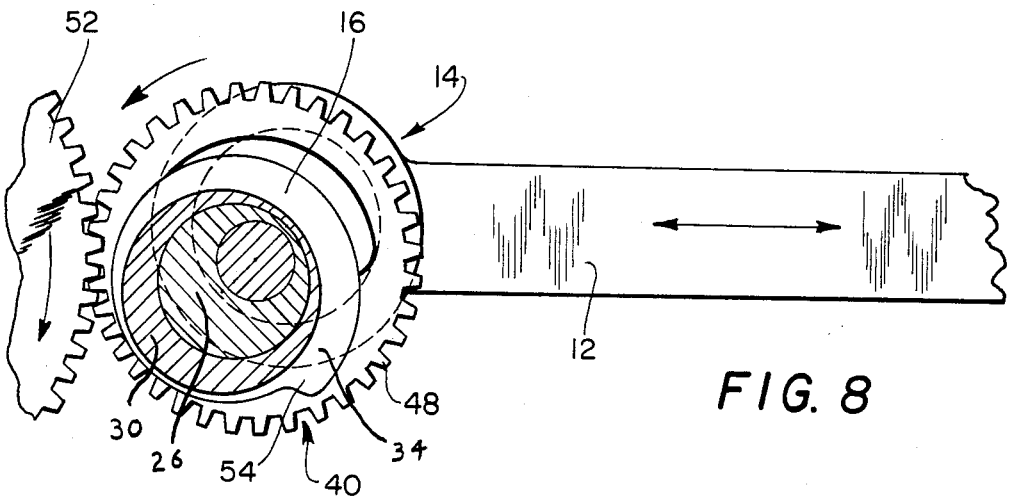
FIG. 8 is an enlarged end view, partly in section, showing the mechanism as used on the FIG. 1 machine in normal long stitch sewing position.

As shown in FIG. 8, the pneumatic motor 50 drives the wheel 52 counterclockwise which drives the adjustment wheel 40 clockwise. The relative speeds are such that the pneumatic motor drives the adjustment wheel faster than the rotation of the shaft 16 but in the same direction. The adjustment wheel 40 is therefore pushed and retained at its position shown in FIG. 8 which is the normal operating position of the machine.

When the operator reaches the end of a seam and wishes to tack the stitch, he or she pushes a suitable switch which cuts the air to the pneumatic motor and causes it to idle. Since the shaft 16 continues to run, the shaft now outstrips the wheel 40 which is immediately rotated counterclockwise into the position shown in FIG. 9. This shortens the stitch to allow the tacking. Starting the pneumatic motor reverses the operation and throws the wheel 40 back into normal running position.

Figure 9:
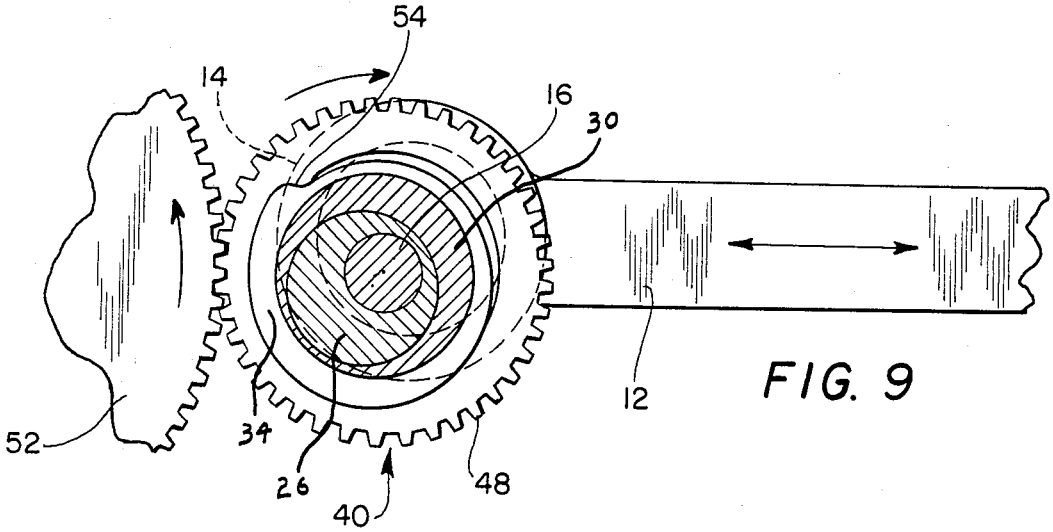
FIG. 9 is a view similar to FIG. 8 with the mechanism in short stitch tacking position.

The multiple cams accomplish this operation as shown in FIGS. 8 and 9 by changing the distance of the loop drive from the center of the shaft 16. In FIG. 8, the shaft is located at one side and the drive is at its greatest, forming the longest stitch, for example, about 3 to the inch. FIG. 9 shows that the adjustment has moved the shaft 16 closer to the center of the loop 14 to shorten the drive so that the stitches are now 10 to 14 to the inch.

It should be noted that the cam edge at 54 engages the chord portion 44 to limit the movement of the adjustment wheel 40 in each direction. With the present invention, the feed drive remains stable at the sewing head and the adjustment is made at the normal ajustment area of the machine. The present invention merely loosens the adjustment and swings it from long to short stitching while the machine is running.

Figure 10:
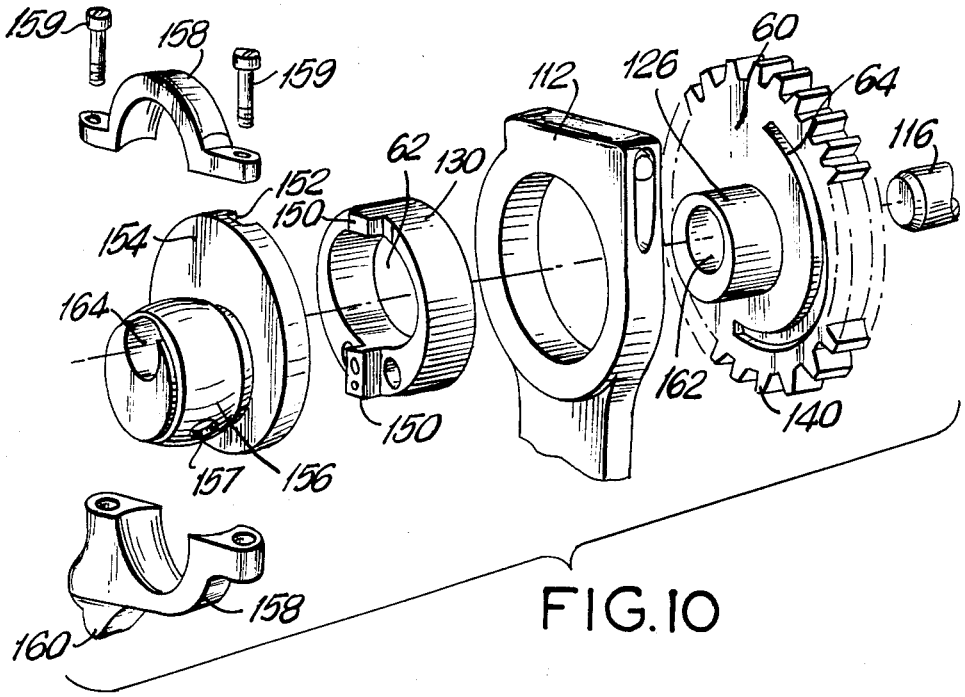
FIG. 10 is a view analagous to FIG. 4 showing another embodiment of the present invention as used on a different type of blind stitch machine.
Figure 12:
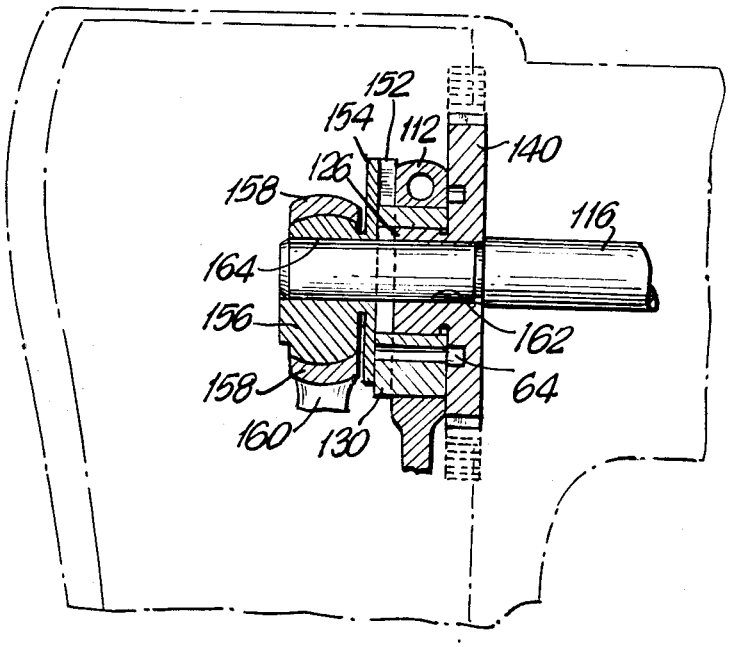
FIG. 12 is a vertical sectional view of the embodiment of FIG. 10, in assembled condition.
Figure 11:
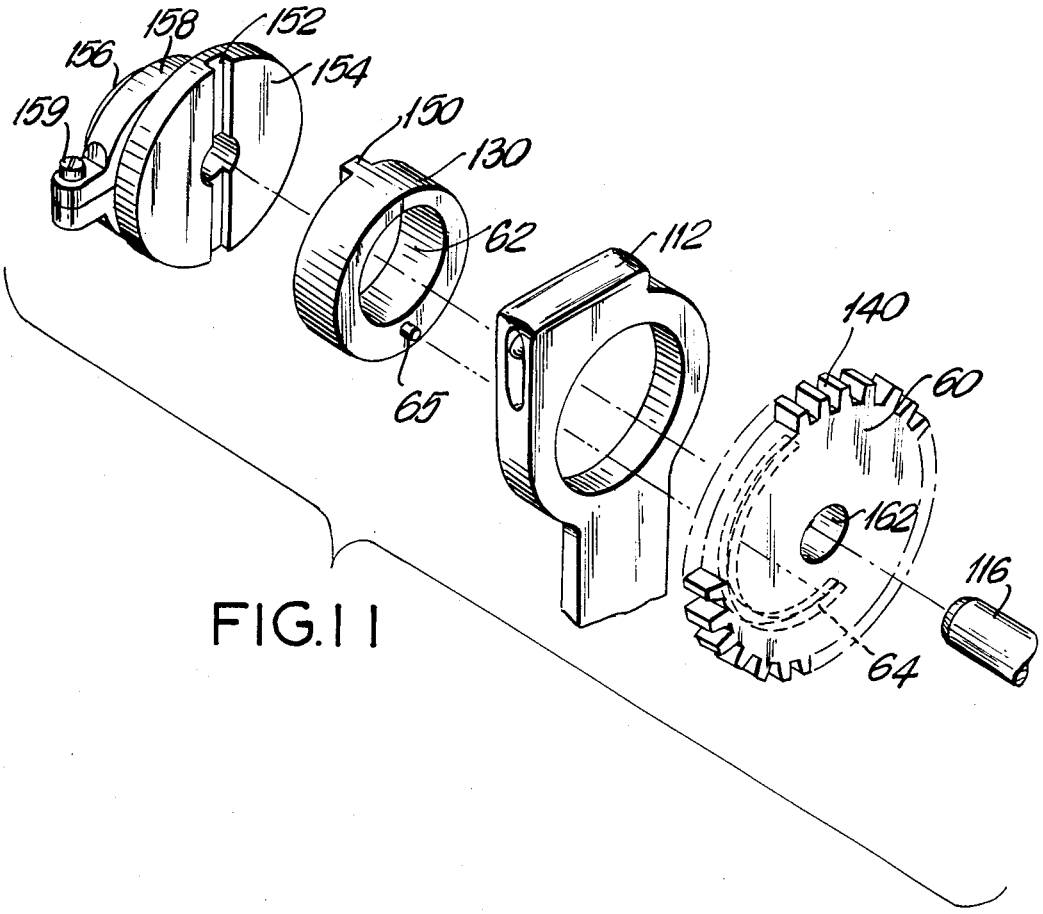
FIG. 11 is a view similar to FIG. 10 taken from the opposite direction.

FIGS. 10–12 illustrate a modified embodiment of the stitch shortening device, said modified embodiment intended for use with a Lewis Blind Stitch Machine. Only those parts of a Lewis Machine necessary for an understanding of the invention are shown herein. As seen in the drawings, in the modified embodiment eccentric cam 126 is integral with and extends from a front face 60 of a toothed adjustment wheel 140. Drive cam 130 rides on cam 126 via opening 62 and feed lever 112 surrounds the cam 130. A pin 65 extends rearwardly from the cam 130 and is received in arcuate slot 65 in the front face 60 of wheel 140. The front face of the cam 130 is provided with diametrically spaced projections 150 that are received in complementary formed recesses 152 in the rear of the plate 154 connected to the needle driving eccentric cam 156. A yoke 158, held together by screws 159, connects the ball connecting rod 160 to cam 156. Drive shaft 116 extends through opening 162 in cam 126 and 164 in cam 156. A set screw 157 connects cam 126 to the shaft.

The action of the embodiment of FIGS. 10–12 is similar to that of the embodiment of FIGS. 1–9. That is, the rod 112 is driven by the cam 130 whose attitude on the cam 126 is controlled by the wheel 140. A pneumatic motor, through an appropriate gear (not shown) drives the wheel 140 slightly faster than the shaft 116 and in the same direction. The wheel, in turn, rotates the cam 130 to the long stitch position by one end wall of the slot 64 engaging the 65. When the operator cuts power to the pneumatic motor, the wheel 140 idles and rotates opposite to the direction of rotation of shaft 116 until the other end of the slot 64 engages the pin 65. This changes the position of cam 130 on cam 126, bringing the arm 112 closer to the axis of rotation and thereby shortening the stitch. Energizing the pneumatic motor again drives wheel 140 to lengthen the stitch.

While preferred embodiments of the invention have been shown and described herein, it will be obvious that numerous changes, additions and deletions may be made in such embodiments without departing from the spirit and scope of the present invention.

What is claimed is:

1. A variable stitching device for a sewing machine having a feed drive lever for operating the feed dog, a drive shaft from the sewing machine, and means on the drive shaft for reciprocating the lever, comprising a multiple cam mounted on the drive shaft, adjustment means for adjusting the relative positions of said cams, the feed drive lever having an integral loop, said multiple cams extending through the loop to reciprocate the lever, and drive means for operating said adjustment means during actuation of the sewing machine.

2. A device as in claim 1, wherein said multiple cams comprises two eccentric cams one inside of the other, the shaft extending through said inner cam.

3. A device as in claim 2, wherein said adjustment means includes a toothed wheel mounted to engage said outer cam, said wheel adjusting the relative positions of said cams to each other.

4. A device as in claim 2, wherein the loop of the drive feed lever is mounted on said outer cam.

5. A device as in claim 5, wherein said adjustment means includes a toothed wheel mounted to engage said outer cam, said wheel adjusting the relative positions of said cams to each other.

6. A device as in claim 1, wherein said multiple cams comprise an inner and outer cam, the loop of the drive feed lever being mounted on said outer cam.

7. A device as in claim 1, wherein said adjustment means includes a pneumatic motor mounted on said machine, a toothed wheel driven by said motor, said toothed wheel driving one of said multiple cams to retain said cams in normal running position when said motor is operated and to move said cams to stitch shortening position when said motor is deenergized.

8. A device as in claim 7, wherein said multiple cams comprise two eccentric cams one inside of the other, the drive shaft extending through said inner cam.

9. A device as in claim 8, wherein the loop of the feed drive lever is mounted on said outer cam.

* * * * *